US008578946B2

(12) United States Patent
Ellery

(10) Patent No.: US 8,578,946 B2
(45) Date of Patent: Nov. 12, 2013

(54) METHOD FOR FABRICATING HAIR EXTENSIONS

(75) Inventor: Lucinda Ellery, London (GB)

(73) Assignee: Lucinda Ellery, Inc., London (GB)

( * ) Notice: Subject to any disclaimer, the term of this patent is extended or adjusted under 35 U.S.C. 154(b) by 0 days.

(21) Appl. No.: 13/303,146

(22) Filed: Nov. 23, 2011

(65) Prior Publication Data

US 2013/0125913 A1 May 23, 2013

(51) Int. Cl.
*A41G 3/00* (2006.01)
*A41G 5/00* (2006.01)

(52) U.S. Cl.
USPC ..... 132/201; 132/53

(58) Field of Classification Search
USPC ..... 132/201, 53–56
See application file for complete search history.

(56) References Cited

U.S. PATENT DOCUMENTS

2012/0260933 A1* 10/2012 Ourique et al. ..... 132/201

* cited by examiner

*Primary Examiner* — Rachel Steitz

(57) ABSTRACT

A method of fabricating hair extensions including the steps of integrating a person's natural hair strands with a sheet of mesh for the purpose of fabricating a foundation upon which hair extensions may be affixed, fabricating a plurality of connection anchors between the person's natural hair and the sheet of mesh to anchor the sheet of mesh onto the person's scalp, stitching a plurality of hair panels to the sheet of mesh for the purpose of covering bald regions on the person's scalp, and stitching a plurality of custom lace panels to the sheet of mesh near an upper region of the person's scalp. The hair panels and lace panels are secured and anchored firmly to the scalp hair to form a pull-resistant hair extension network.

12 Claims, 9 Drawing Sheets

Figure 1:
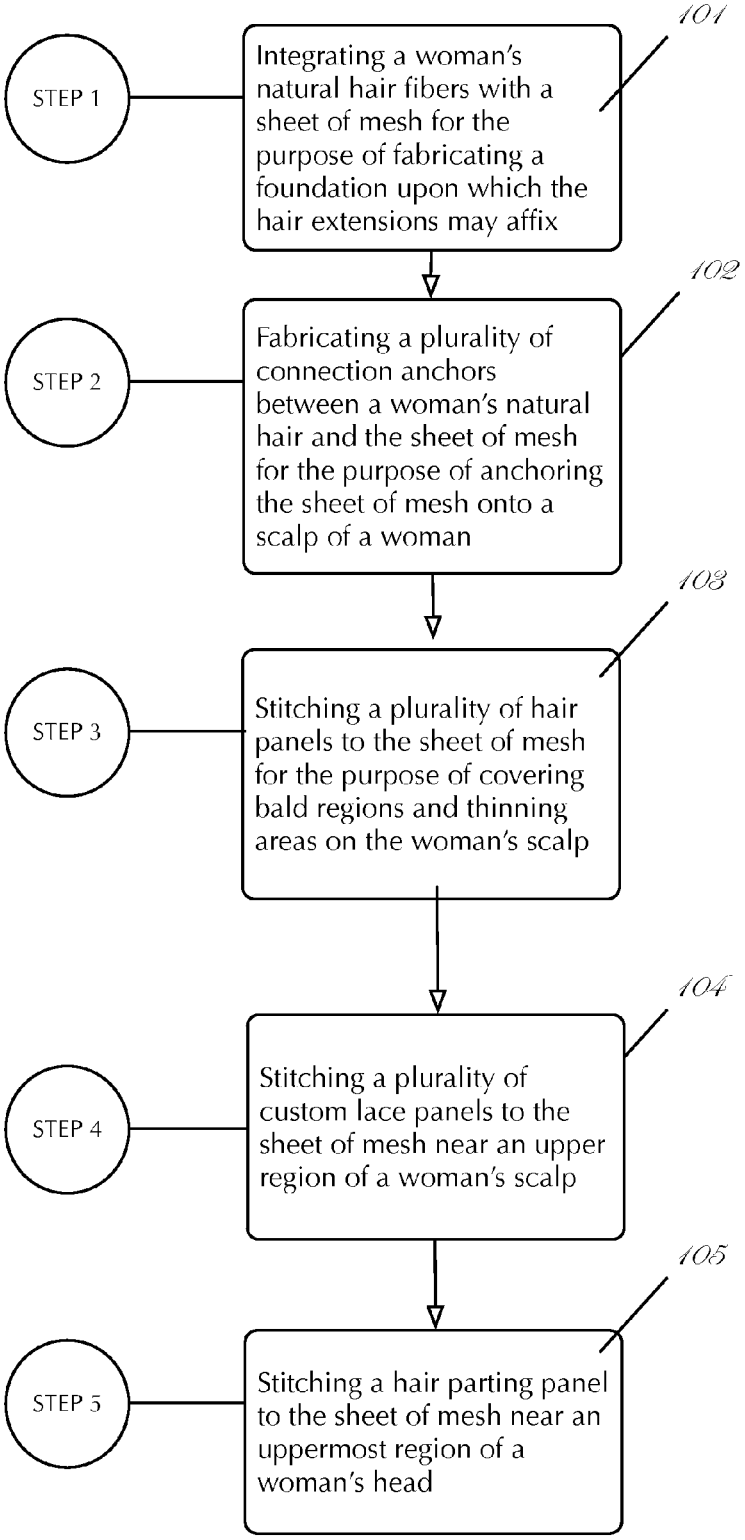

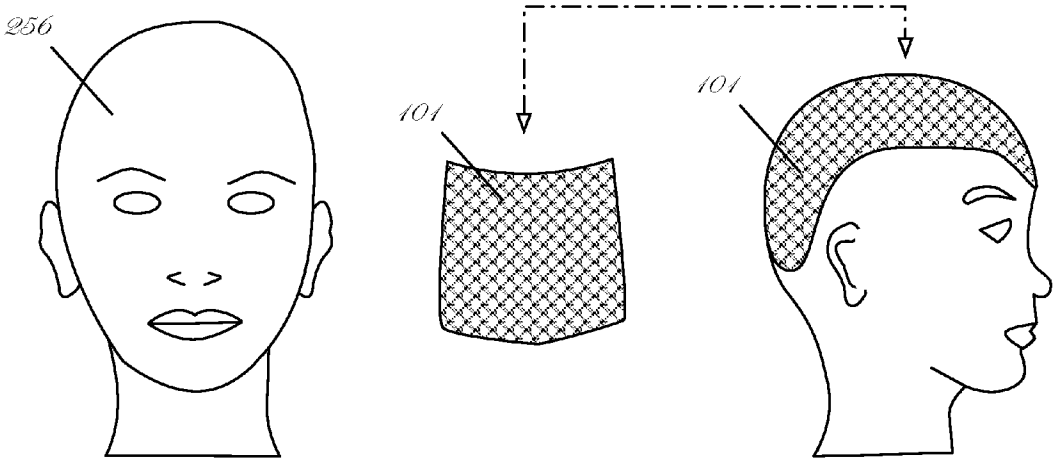
Fig. 2
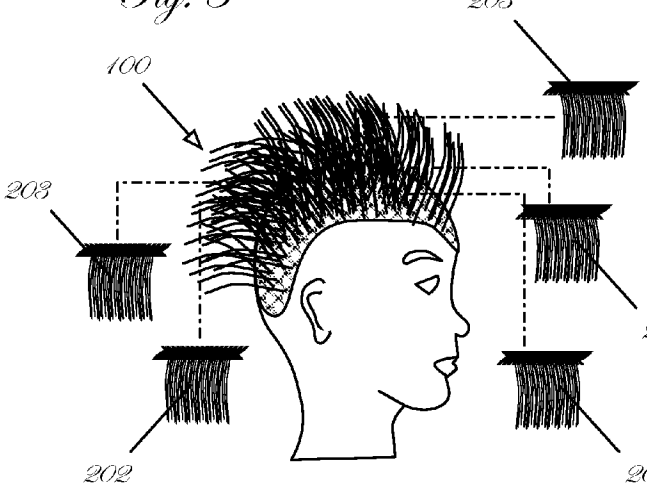
Fig. 3
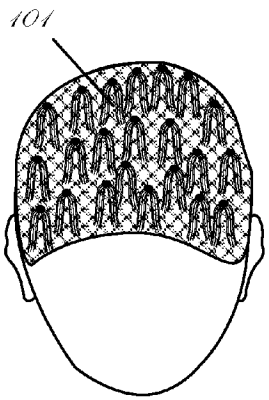
Fig. 4
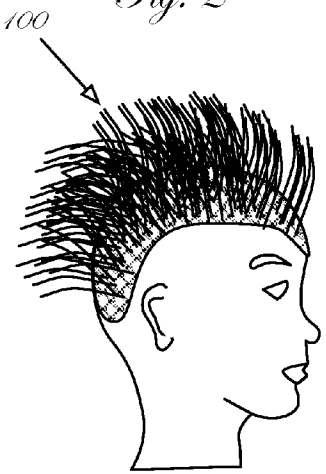
Fig. 5
Fig. 6
Fig. 7

METHOD FOR FABRICATING HAIR EXTENSIONS

FIELD OF THE INVENTION

The present invention is in the area of Cosmetology and more particularly pertains to a method for fabricating hair extensions on a woman utilizing a mesh-based foundation for covering bald spots on the head of a woman in a durable, seamless, and inconspicuous fashion.

BACKGROUND OF THE INVENTION

One of the most difficult physical changes for both men and women to endure is the loss of hair. For many, the loss of hair is a loss of youth, vitality, and beauty. For others, it is a shrill harbinger of our mortality. Although many men are able to cope with the loss of hair, women oftentimes find it even more devastating.

In particular, when it comes to hair, women spend far more time, energy, and money for the perfect style as compared with men. Beauty magazines dedicate reams of pages detailing the latest trends, color combinations, maintenance, and the like. And so it comes as no surprise that women who experience hair loss feel isolated, and a profound sense of loss.

Although various devices, techniques, and advice are available to treat hair loss in women, many of these products and services are ill-suited for use on a permanent basis and/or impractical for use under intemperate conditions such as rain, wind, and excessive heat.

For example, many women use wigs to combat hair loss. A problem with wigs is that poor anchoring to a woman's scalp can cause the wig to jostle about on a woman's head because it has no way of securing itself to the scalp. This leads to embarrassing changes of position which can signal to the public that the wig is not natural hair and that the wearer is experiencing hair loss. Other techniques such as hair extensions may not provide complete coverage. For instance, if large swaths of hair strands are missing from a scalp, hair extensions may not be able to completely and naturally cover those bare regions.

A related problem some women experience is an impulse control disorder called Trichotillomania. Sufferers of this disorder are compulsively compelled to pull their hair out. Typically, this results in bald regions on their scalps, which are difficult to cover.

SUMMARY

In one embodiment, a method for fabricating hair extensions on a woman using a mesh-based foundation includes the steps of integrating a woman's natural hair strands with a sheet of mesh, fabricating a plurality of connection anchors between a woman's natural hair and the sheet of mesh, stitching a plurality of hair panels to the sheet of mesh, stitching a plurality of custom lace panels to the sheet of mesh near an upper region of a woman's scalp, and stitching a hair parting and panels to the sheet of mesh near an uppermost region of a woman's head. Collectively, the hair panels, lace panels and hair partings are secured and anchored firmly to the sheet of mesh foundation, and are resistant to wind, water, and other forces or conditions.

BRIEF DESCRIPTION OF THE DRAWING FIGURES

FIG. 1 is a block diagram of an embodiment.
FIG. 2 is a plan view of an embodiment.

Figure 8:
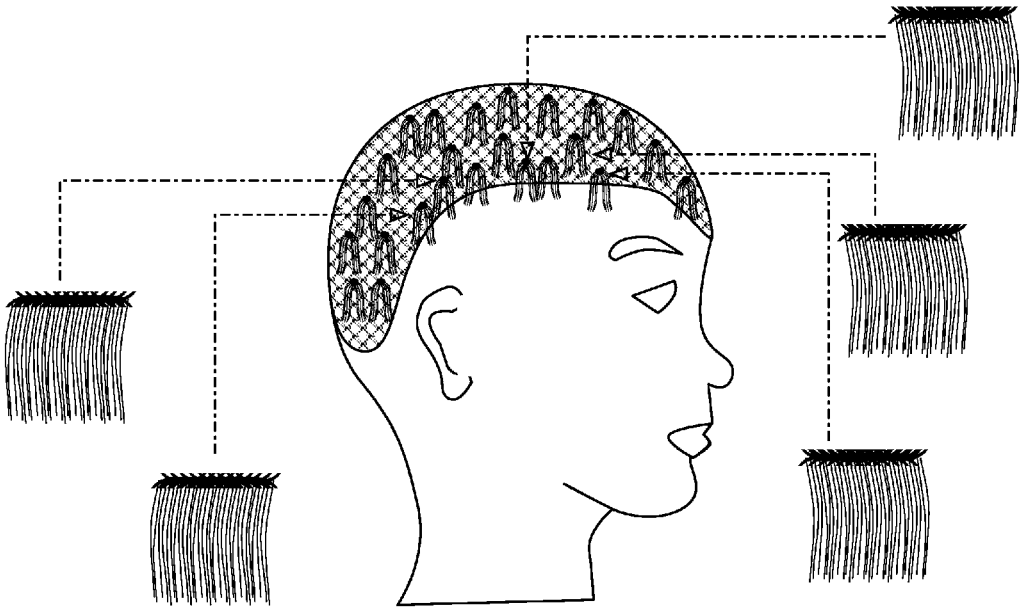
Figure 9:
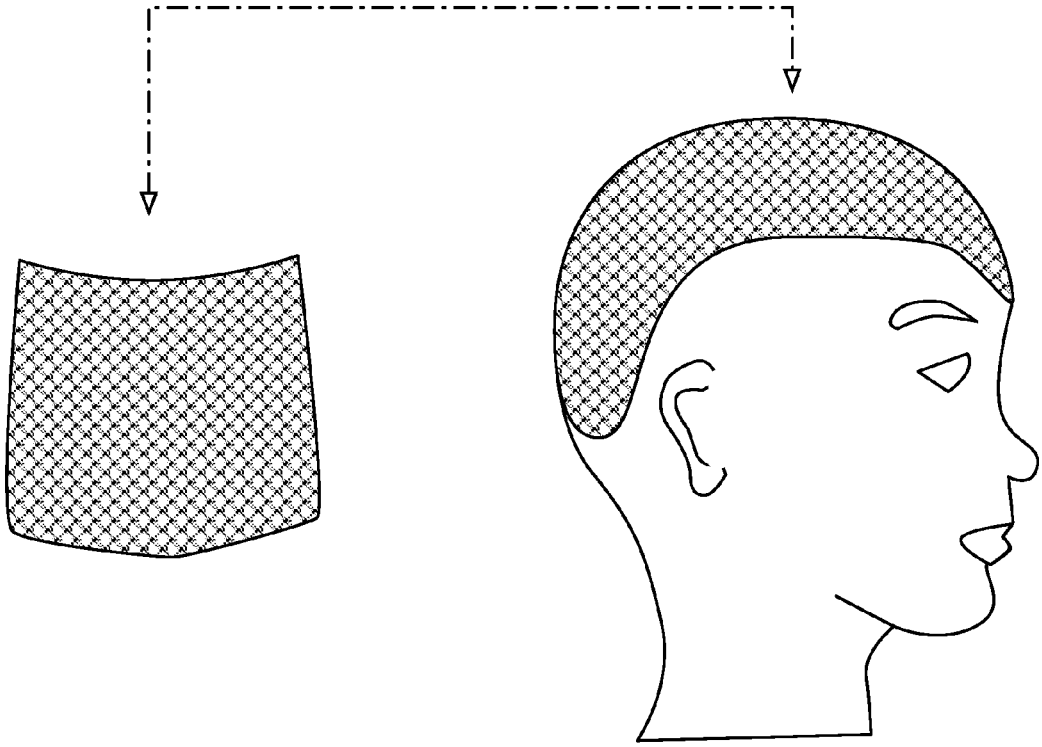
Figure 10:
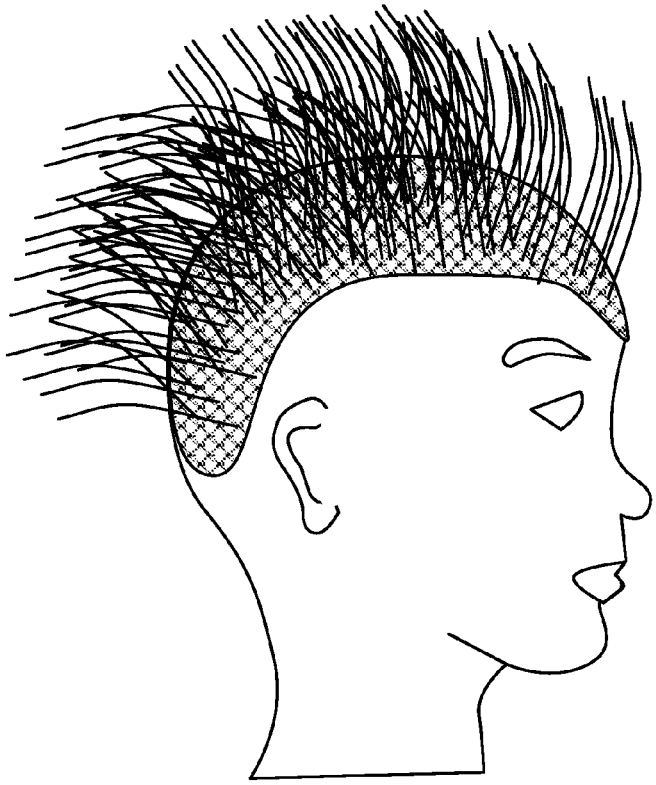
Figure 11:
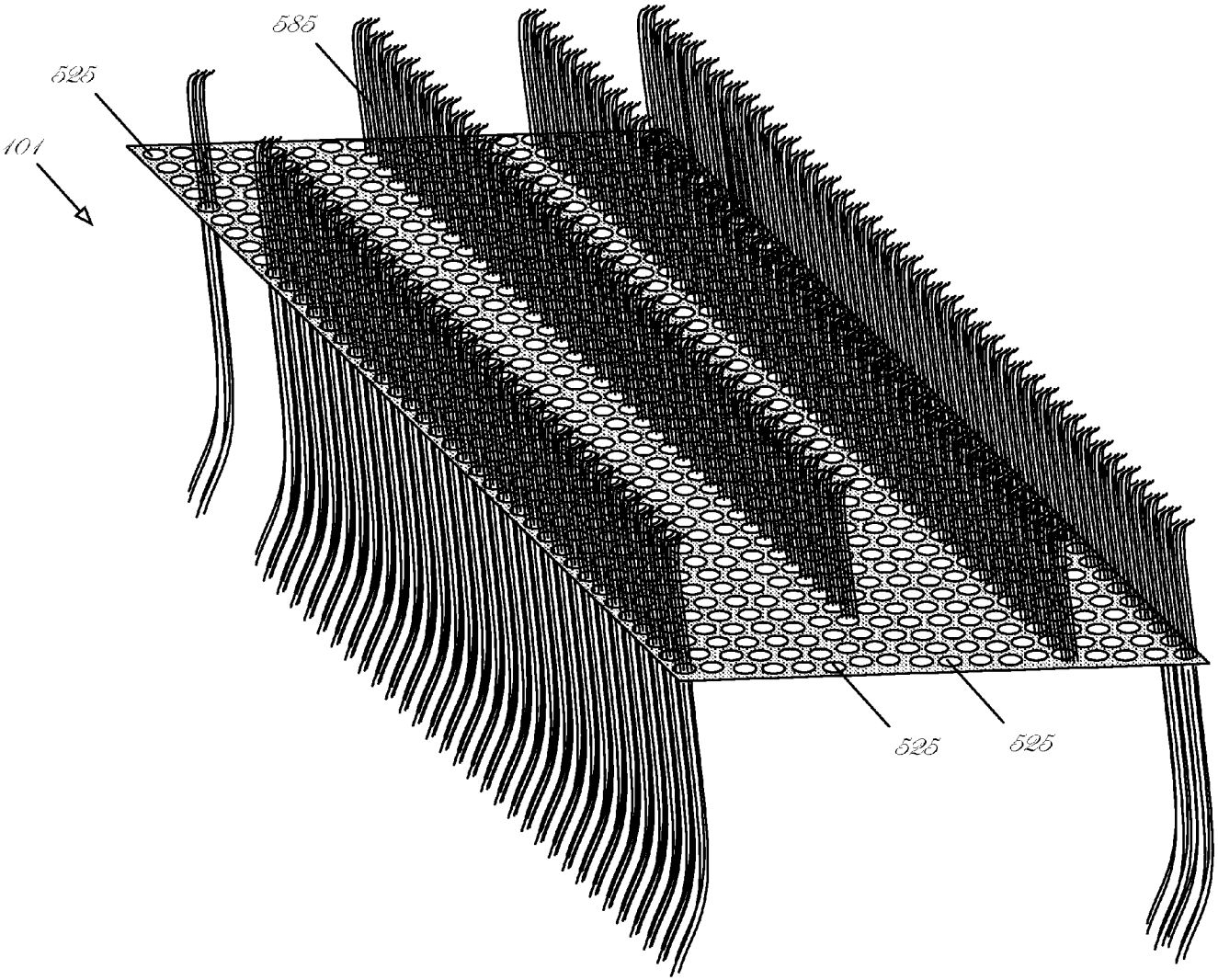
Figure 14:
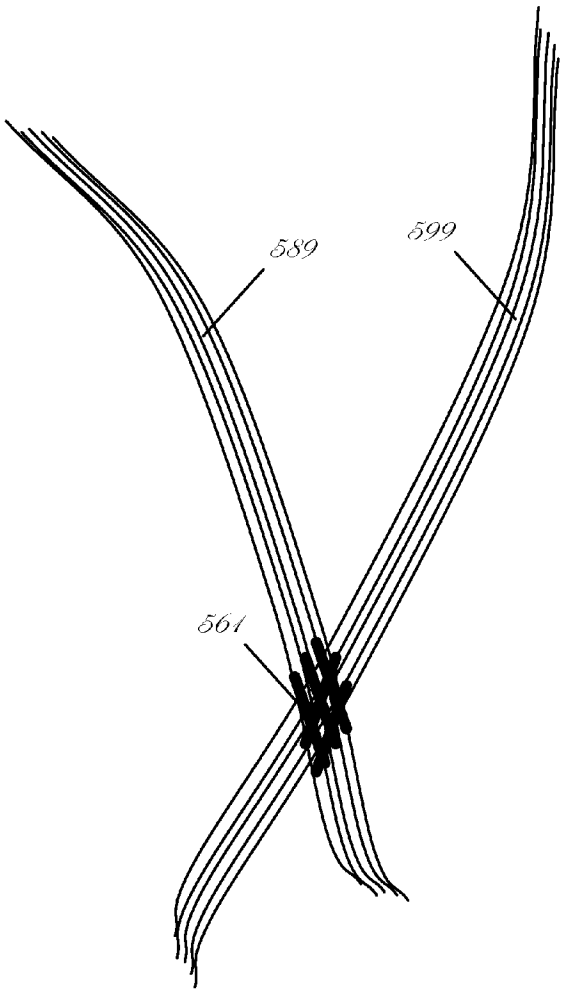
Figure 13:
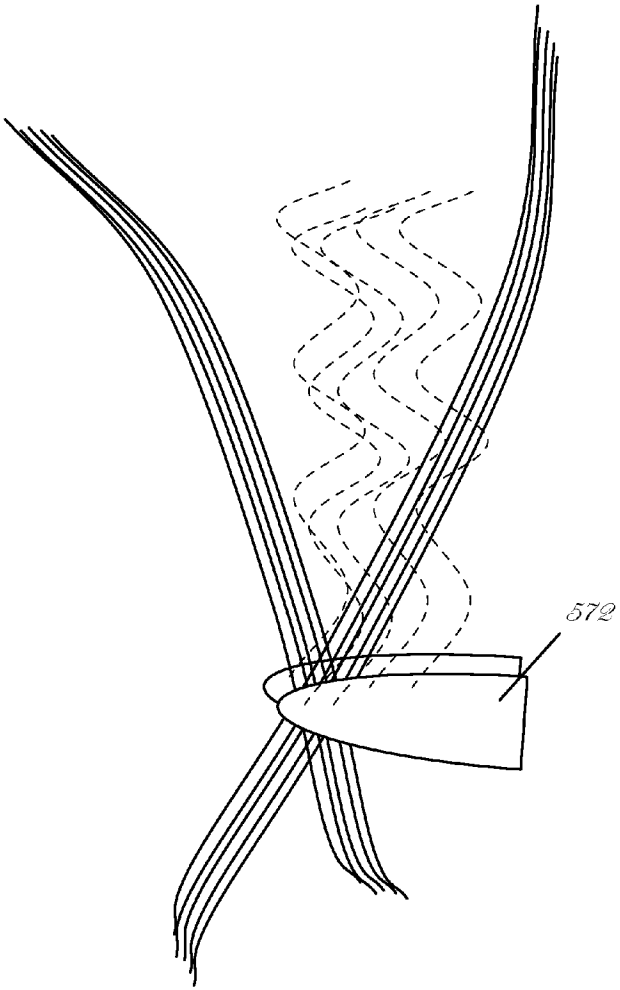
Figure 12:
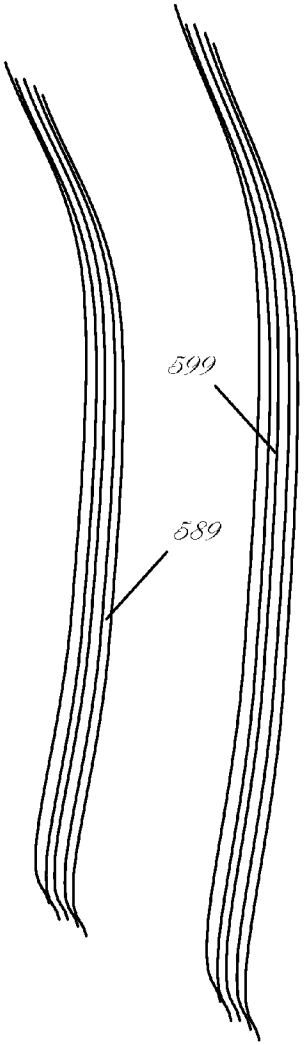
Figure 15:
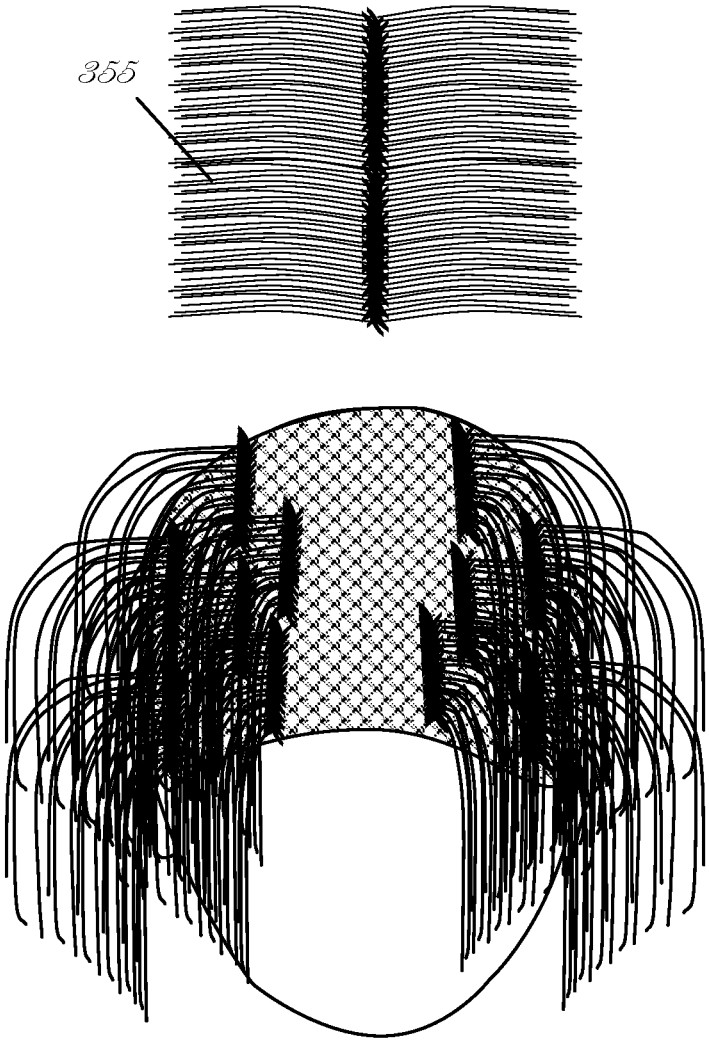
Figure 16:
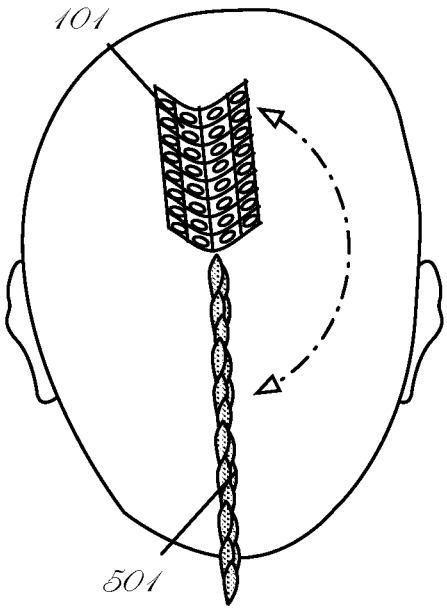
Figure 17:
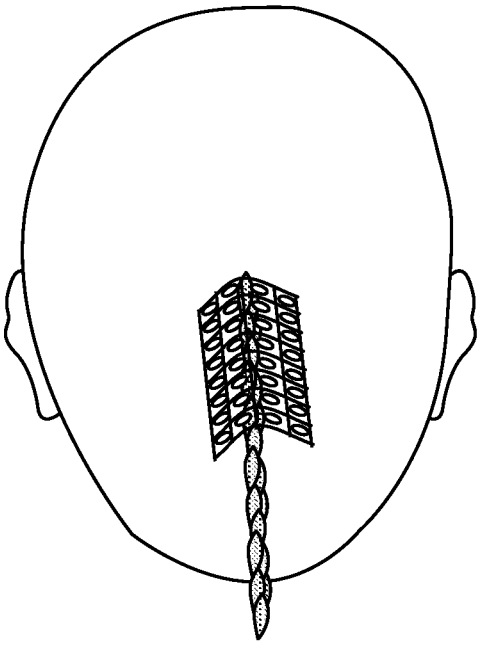
Figure 18:
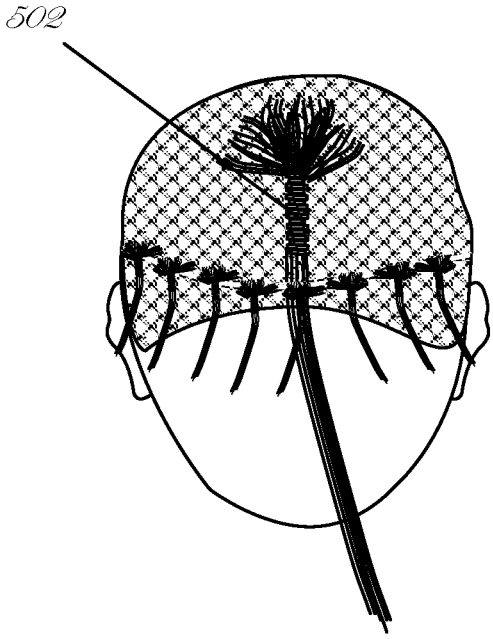
Figure 19:
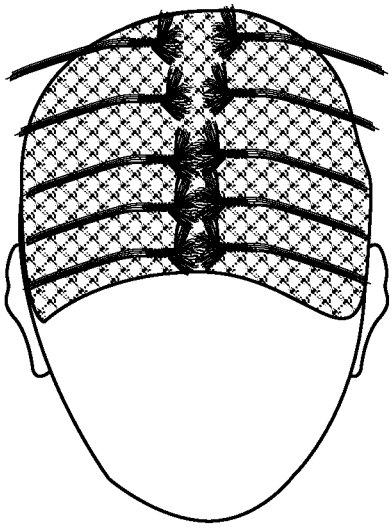

FIG. 3 is a front elevation view of an embodiment.
FIG. 4 is a side elevation view of an embodiment.
FIG. 5 is a side elevation view of an embodiment.
FIG. 6 is a plan view of an embodiment.
FIG. 7 is a rear elevation view of an embodiment.
FIG. 8 is a side elevation view of an embodiment.
FIG. 9 is a side elevation view of an embodiment.
FIG. 10 is a side elevation view of an embodiment.
FIG. 11 is a perspective view of an embodiment.
FIG. 12 is a perspective view of an embodiment.
FIG. 13 is a perspective view of an embodiment.
FIG. 14 is a perspective view of an embodiment.
FIG. 15 is a plan view of an embodiment.
FIG. 16 is a plan view of an embodiment.
FIG. 17 is a plan view of an embodiment.
FIG. 18 is a plan view of an embodiment .
FIG. 19 is a plan view of an embodiment.

DETAILED DESCRIPTION

According to an embodiment of the present invention, a unique method for fabricating hair extensions using a mesh-based foundation is provided for the purpose of covering bald spots or hair thinning on the head of a woman in a durable, seamless, and inconspicuous fashion. The method is also used to treat women diagnosed with Trichotillomania. The present invention is described in enabling detail below.

For the purposes of the following description, the system, methods, and facility can be equally expedient for use with women experiencing thinning hair. The embodiments described herein are not solely used for the purpose of treating female baldness or Trichotillomania.

For the purposes of the following description, the term "Hair Extension" shall alternately refer to lace panels, hair panels, or the natural hair parting, or any other assemblage of exogenous hair. For the purposes of the present invention, the term "practitioner" shall refer to those employees or other individual of the hair treatment facility who perform the tasks involved with the disclosed methods and procedures.

For the purposes of the following description, the term "intralace" shall hereinafter refer to the hair integration system used to fabricate the hair extensions on the head of a woman. Furthermore, this intralace system can alternatively be referred to as a cranial hair prosthesis. All preceding definitions are not meant to be construed to be limiting to their ordinary and typical usage, or meanings.

FIG. 1 illustrates a method for fabricating hair extensions on a woman using a mesh-based foundation 100. The method may include the steps of integrating a woman's natural hair strands with a sheet of mesh 101, fabricating a plurality of connection anchors between a woman's natural hair and the sheet of mesh 102, stitching a plurality of hair panels to the sheet of mesh 103, stitching a plurality of custom lace panels to the sheet of mesh near an upper region of a woman's scalp 104, and stitching a hair parting and panels to the sheet of mesh near an uppermost region of a woman's head 105. Collectively, the hair panels, lace panels and hair partings are secured and anchored firmly to the sheet of mesh foundation, and are resistant to wind, water, and other forces or conditions.

In various embodiments, the method is a bespoke fitting hair extension service that entails carefully applying the sheet of mesh around the scalp area to create as snug a fit as possible given each individual's unique skull morphology. It should also be noted that most women who experience hair loss are not completely bald. Consequently, depending on the woman, approximately up to 20-30 hair panels, lace panels, and a natural hair parting may be used to partially or completely cover a woman's scalp. However, most women who experience these conditions of hair loss do not exhibit large swaths of bald regions. Rather, most women experience hair loss or removal in isolated regions where some natural hair may still remain.

In such cases, it is typical that hair extensions are only applied to the affected areas of a woman's scalp. That is to say, some women may need extensions exclusively to the side regions of their head, while others may only require a new hair parting or lace panel to the upper regions or their heads.

It should be noted that the method taught herein will only work if a woman has some natural hair remaining. Otherwise, the anchoring mechanism through which the method operates will not fabricate a reliable foundation upon which the intra-lace hair extensions will affix.

It should be noted here that the hair extensions to be used by the method may either be synthetic or natural hair. For the purposes of the present invention, the term "organic" hair shall refer to exogenous, or another person's donated natural hair. It should be noted here that the hair panels can be fabricated by using polyurethane as the binding agent through which the groups of hair are bound together at the root area. In another embodiment, an acrylic based adhesive is applied to a woman's natural hair.

FIG. 4 illustrates that the first step involves integrating a woman's natural hair strands with a sheet of mesh 101. The purpose of this step is to fabricate a foundation upon which the hair extensions may affix. This mesh consists of a plurality of cells 525, which are generally oval in shape. These cells are sized to accept a plurality of hair strands 585.

FIG. 11 illustrates that in operation, a practitioner will individually retrieve a woman's natural hair through the cells of the mesh. This may be accomplished by using a crochet hook or other suitable tool. Depending upon how many hair extensions will have to be integrated, this process can be quite laborious and painstaking in its execution. Some applications can take well over eight hours.

FIGS. 16-17 illustrate that in one alternate embodiment, the hair is braided into cane rows, or corn rows by the practitioner. Afterwards, the sheet of mesh is stitched onto the corn row.

FIGS. 12-14 illustrate the next step of fabricating a plurality of connection anchors 561 between a woman's natural hair strands 599 in combination with synthetic hair 589 to secure the sheet of mesh. This step is performed with a set of heated prongs 572 or other similar device for the purpose of melting the synthetic hair around the natural hair using a plaiting technique.

First, a practitioner will plait the woman's natural hair with synthetic hair strands. Upon completing the plait, the practitioner will then wrap a plurality of synthetic hair strands around the plait.

Subsequently, the practitioner will heat-seal the synthetic hair. In operation, the practitioner will apply a set of heated prongs 572 thereby urging a melting temperature point at which the synthetic hair strands 589 will melt around the natural hair 599. As the melted amalgamation of the synthetic hair with the plait congeals, a strong and durable connection point or anchor 561 is formed. This amalgamation is sometimes referred to in the art as a "hair plait" connection point.

The synthetic hair has a far lower melting point as compared with human hair, so the synthetic hair will melt around the plait to create a finished seal. Upon completion, the practitioner will remove the trailing synthetic hair strands.

FIGS. 18-19 illustrate an alternative embodiment in which a threading technique is used to integrate the sheet of mesh with the scalp of a woman. With this technique, a practitioner will wrap thread 502 around the plait so that it will not unravel. Afterwards, a quantity of cotton thread is tied around the plait to stop the unraveling.

In various embodiments, a practitioner may use a bonding technique whereby an acrylic based adhesive is applied within approximately 10 mm of the scalp to the natural hair that has been retrieved through the sheet of mesh. In another embodiment, the acrylic based adhesive is substituted with another polymer adhesive.

These connection points or anchors serve as the foundation upon which the additional hair is anchored to the sheet of mesh. These connection points are applied at a point of less than 2 mm from the surface of the scalp. The closer the connection point is made to the surface of the scalp, the stronger and more secure the foundation. This connection point is the structure, which prevents the underlying sheet of mesh from rising up out of a woman's bundle of hair.

In one embodiment, the connection points are formed through an alternative method of using a micro-ring, as opposed to the melting of the synthetic hair around the natural hair in the plait. The micro-ring is a cylindrical tube sized to accept a plurality of natural, synthetic, and organic hair strands. For the sake of illustration, a typical micro-ring can measure around 10 mm in length, with a diameter between 2-5 mm. The preceding dimensions are not meant to be limiting as to the scope of the present application.

A practitioner will insert a micro-ring over the hair strands, and then pull the natural hair down longitudinally through the micro-ring, such that the micro-ring is disposed as close to the scalp as possible.

Afterwards, the practitioner will use a device to crimp the micro-ring to retain it in place. In one embodiment, the micro-ring is made of plastic or metal. In other embodiments, the micro-ring is made of a resilient material capable of being crimped by a tool such that the crimping will create a strong interference fit around the hair strands. By crimping the micro-ring, a strong interference fit is made between the micro-ring and the hair strands disposed longitudinally within the micro-ring. Again, as with the melted hair technique, the micro-ring also creates a connection anchor. This connection anchor prevents the sheet of mesh from moving away from the scalp. As a consequence, the sheet of mesh acts as a powerful anchor to which the hair extensions will be stitched or affixed thereto.

FIG. 6 illustrates that the next step involves stitching a plurality of hair panels 102 to the sheet of mesh. This is for the purpose of covering bald regions on the woman's scalp. These hair panels are typically applied to the lower side regions of a woman's scalp. Again, as noted above, the number of hair panels to be affixed to the sheet of mesh will depend upon how much hair loss or hair removal the woman has experienced to the lower, side regions of her head.

In one embodiment, the hair panels are fabricated through use of a binding agent such as polyurethane. In another instance, the hair panels may be comprised of a bonded weft. In another instance, the hair panels may be comprised of a weft stitched to the sheet of mesh using either synthetic or organic hair.

The next step involves stitching a plurality of custom lace panels 203 to the sheet of mesh near an upper region of a woman's scalp. These custom lace panels may differ in terms of the length of the hair. Typically, the lace panels will be smaller in widths but larger in depth than the hair panels. In one embodiment, the lace panels are fabricated through use of a binding agent such as polyurethane. In other embodiments, they may be comprised of silk lace with organic hair or synthetic hair applied to the sheet of mesh. In another embodiment, an acrylic based adhesive is applied to a woman's natural hair.

The last step involves stitching a hair-parting 355 to the sheet of mesh near an uppermost region of a woman's head for the purpose of covering bald spots and for creating a natural hair parting break area with skin effect on the head of a woman in a durable, seamless, and inconspicuous fashion.

In one embodiment, the hair parting is constructed using a silk base material through which the hair strands are individually hand-knotted. Through this construction, the hair strands are held firmly in place. Moreover, the silk gives the appearance of a natural scalp break in the parted hair.

In another embodiment, the custom-made hair partings are made by injecting hairs into a polyurethane base material. This also is durable and creates a scalp effect when the hair is separated. The type of parting produces a slightly different effect in comparison to the silk based parting.

In another embodiment, the natural hair line parting is custom-made using a silk or polyurethane base material which has a lace frontal area attached with this parting with custom polyurethane inserts injected into the front lace material. The hair is hand-knotted into the front lace material thereby creating a natural hair line appearance.

It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. A method of fabricating hair extensions comprising the steps of:

integrating a person's natural hair strands with a sheet of mesh for the purpose of fabricating a foundation upon which hair extensions may be affixed;

fabricating a plurality of connection anchors between the person's natural hair and the sheet of mesh to anchor the sheet of mesh onto the person's scalp;

stitching a plurality of hair panels to the sheet of mesh for the purpose of covering bald regions on the person's scalp; and stitching a plurality of custom lace panels to the sheet of mesh near an upper region of the person's scalp;

whereby the hair panels and lace panels are secured and anchored firmly to the scalp hair to form a pull-resistant hair extension network.

2. The method of claim 1 wherein the step of fabricating a plurality of connection anchors between the person's natural hair and the sheet of mesh is achieved by melting and fusing strands of synthetic hair with the person's natural hair using a heating device.

3. The method of claim 1 wherein the step of integrating the natural hair strands with the sheet of mesh further includes pulling hair strands through an individual cell of the sheet of mesh such that the mesh is pulled near the person's scalp.

4. The method of claim 1 further including:

pulling a plurality of hair strands through a micro-ring;

pulling the micro-ring near the person's scalp; and crimping the micro-ring with a tool to create an interference fit between the micro-ring and the hair strands.

5. The method of claim 4 wherein the micro-ring is plastic.

6. The method of claim 1 further comprising the step of stitching at least one hair parting to the sheet of mesh near an uppermost region of the person's head.

7. The method of claim 1 wherein integrating the sheet of mesh with the person's scalp comprises the step of applying an acrylic based adhesive to the person's natural hair within 10 mm of their scalp.

8. The method of claim 1 wherein integrating the sheet of mesh with the person's scalp comprises the steps of braiding the person's natural hair into cane rows and stitching the mesh onto the cane rows.

9. The method of claim 1 further comprising the step of wrapping and tying thread around a plait to stop the plait from unraveling.

10. The method of claim 1 wherein the sheet of mesh comprises oval-shaped cells.

11. The method of claim 10 wherein the oval-shaped individual cells are sized to accept a plurality of hair strands therethrough.

12. The method of claim 1 wherein the connection anchors are fabricated at a point within two millimeters of the person's scalp.

* * * * *